US012612137B2

(12) United States Patent
Bargende et al.

(10) Patent No.: US 12,612,137 B2
(45) Date of Patent: Apr. 28, 2026

(54) DEVICE FOR THE ROLL STABILIZING OF A WATERCRAFT

(71) Applicant: SKF MARINE GMBH, Hamburg (DE)

(72) Inventors: Dirk Bargende, Elmshorn (DE); Sascha Kortemeier, Hamburg (DE); Christopher Schnaeckel, Bargteheide (DE); Holger Spardel, Hamburg (DE)

(73) Assignee: SKF MARINE GMBH, Hamburg (DE)

( * ) Notice: Subject to any disclaimer, the term of this patent is extended or adjusted under 35 U.S.C. 154(b) by 525 days.

(21) Appl. No.: 18/012,484

(22) PCT Filed: Jul. 6, 2021

(86) PCT No.: PCT/EP2021/068679
§ 371 (c)(1),
(2) Date: Dec. 22, 2022

(87) PCT Pub. No.: WO2022/013014
PCT Pub. Date: Jan. 20, 2022

(65) Prior Publication Data

US 2023/0264792 A1 Aug. 24, 2023

(30) Foreign Application Priority Data

Jul. 14, 2020 (DE) ..... 102020208770.9

(51) Int. Cl.
*B63B 39/06* (2006.01)
*B63B 39/14* (2006.01)
*B63H 25/24* (2006.01)

(52) U.S. Cl.
CPC ..... *B63B 39/06* (2013.01); *B63B 39/14* (2013.01); *B63H 25/24* (2013.01); *B63B 2039/067* (2013.01)

(58) Field of Classification Search
CPC . B63B 39/06; B63B 39/061; B63B 2039/065; B63B 2039/067; B63B 39/14; B63H 25/24; B63H 25/26
See application file for complete search history.

(56) References Cited

U.S. PATENT DOCUMENTS 9,944,363 B2 * 4/2018 Venables ..... G05D 1/0875
10,246,170 B2 4/2019 Venables et al.
(Continued)

FOREIGN PATENT DOCUMENTS

DE 1781389 A1 1/1974
EP 2172394 A1 4/2010
(Continued)

OTHER PUBLICATIONS

Anonymous, "Brushless DC electric motor—Wikipedia, the free encyclopedia" Jan. 6, 2014 (Jan. 6, 2014), XP055162563Retrieved from the Internet: URL:https://web.archive.org/web/20140106110311/http://en.wikipedia.org/wiki/Brushless DC electric motor[retrieved on—Jan. 15, 2015]p. 1.
(Continued)

*Primary Examiner* — Ajay Vasudeva
(74) *Attorney, Agent, or Firm* — J-TEK LAW PLLC; Scott T. Wakeman; Mark A. Ussai

(57) ABSTRACT

A device for the roll-stabilization of a watercraft in motion, at anchor, or at zero speed, and/or for influencing the course of the watercraft, includes a fin-carrying shaft on which a guide fin is disposed. For changing an actual angle of attack of the guide fin in the water, the fin-carrying shaft is drivable by an electromechanical drive unit, and the drive unit is disposed on the hull using a base. An electromechanical drive unit is configured with a synchronous motor that drives the fin-carrying shaft using a reducing eccentric transmission. The device thereby has a significantly reduced instal-
(Continued)

lation space requirement, causes only slight operating noises, and is also optimally electronically regulable.

12 Claims, 4 Drawing Sheets

(56) References Cited

U.S. PATENT DOCUMENTS

| | | | | |
|---|---|---|---|---|
| 10,322,778 | B2 * | 6/2019 | Widmark | B63B 43/04 |
| 11,198,492 | B2 * | 12/2021 | Cappiello | B63B 39/06 |
| 11,685,485 | B2 * | 6/2023 | Venables | B63B 39/06 114/126 |
| 2010/0083887 | A1 * | 4/2010 | Cappiello | B63B 39/061 114/126 |
| 2019/0031313 | A1 | 1/2019 | Trivelli | |
| 2019/0185115 | A1 | 6/2019 | Venables et al. | |
| 2019/0202535 | A1 | 7/2019 | Skauen | |

FOREIGN PATENT DOCUMENTS

| | | | |
|---|---|---|---|
| EP | 2452870 | A1 | 5/2012 |
| EP | 2669177 | B1 | 7/2015 |
| EP | 2172394 | B9 | 7/2016 |
| IT | 201800007927 | A1 | 2/2020 |
| JP | S6018491 | A | 1/1985 |
| JP | 2004291773 | A | 10/2004 |
| WO | 2016069859 | A1 | 5/2016 |
| WO | 2017130100 | A1 | 8/2017 |
| WO | 2019021094 | A1 | 1/2019 |

OTHER PUBLICATIONS

International Search Report and Written Opinion dispatched Jan. 20, 2022 for parent application No. PCT/EP2021/068679.

Office Action from the German Patent Office dispatched Apr. 1, 2021 in related German application No. 10 2020 208 770.9, and translation thereof.

Office Action from the Japan Patent Office drafted Jul. 7, 2025 in related application No. 2023-500403, and translation thereof.

* cited by examiner

DEVICE FOR THE ROLL STABILIZING OF A WATERCRAFT

CROSS-REFERENCE

This application is the U.S. National Stage of International Application No. PCT/EP2021/068679 filed on Jul. 6, 2021, which claims priority to German patent application no. 10 2020 208 770.9 filed on Jul. 14, 2020.

BACKGROUND OF THE INVENTION

The invention relates to a device for the roll-stabilization of a watercraft in motion, at anchor, or at zero speed, and/or for influencing the course of the watercraft, including a fin-carrying shaft on which a guide fin is disposed, wherein the fin-carrying shaft is drivable by an electromechanical drive unit for changing an actual angle of attack of the guide fin in the water, and the drive unit is disposed on the hull using a base.

Fin stabilizers for passenger ships, larger yachts, floating pontoons, and the like are known from the prior art in a wide range of variations. Here in general quadrangular fin shapes are used. With the quadrangular fin types, it is sought to arrange the fin shaft as close as possible to the front fin edge for optimizing the hydrodynamically effective fin surface for roll-stabilizing at anchor or at zero speed of the ship.

An automatic anti-roll-stabilization system of a watercraft is known from EP 2 172 394 B9. The previously known system for the stabilizing of rolling movements of a watercraft at anchor comprises, inter alia, a stabilizing fin that can rotate about an axis and that is attached transverse to a longitudinal extension of a hull of the watercraft. The stabilizing fin has a hydrodynamic profile that is impinged in operation by the water stream with a relative movement with respect to the hull in order to generate a hydrodynamic lifting force. Furthermore, the system includes an actuator assembly that is configured to effect a rotation of the stabilizing fin about the mentioned axis, wherein the actuator assembly is regulable by a regulating system in a manner depending on a roll signal of the watercraft. For this purpose the regulating system includes sensor means for generating a roll signal. To regulate the angular position of the stabilizing fin, the regulating system is coupled with an encoder. The regulating system also includes a microprocessor regulating unit that is configured to process the roll signal that is provided by the sensor means. A control unit serves for controlling the electric motor. The actuator assembly includes an electric motor that is connected to the stabilizing fin via a planetary gear speed-reducing transmission, wherein an input shaft of the speed-reducing transmission is attached to an output shaft of the electric motor, and an output shaft of the speed-reducing transmission is attached relative to the shaft that supports the stabilizing fin, wherein the encoder is coupled with the electric motor.

SUMMARY OF THE INVENTION

An object of the invention is to specify a device for roll-stabilization and/or influencing the course of a watercraft with a reduced installation space requirement and reduced operating noises with an optimal regulability.

The above-mentioned object is achieved by the electromechanical drive unit being formed with a synchronizing motor that drives the fin-carrying shaft using a speed-reducing eccentric transmission. Due to the electromechanical drive unit, a spatially compact, cost-effective, and lownoise device is realizable for the roll-stabilizing of a watercraft with a high degree of efficiency. In comparison to conventional electro-hydraulic drives, the device requires no complex tubing, so that a reduced installation and maintenance effort results. The device is operable with small quantities of oil, and no transverse forces arise with the generation of torque. In addition, the electromechanical drive device is electronically regulable in an outstanding manner. A base of the device, which base is connected to the ship hull, requires a lower manufacturing precision, wherein in particular fitted bolts are no longer required. A water cooling is generally required instead of an air cooling. Due to the water cooling of the synchronous motor, a still-lower noise level and a more compact design is achieved in comparison to an air cooling.

The eccentric transmission preferably includes two toothed wheels circumferentially offset with respect to each other by preferably 180°. As a result thereof, optimal smooth-running properties arise with a simultaneously minimized noise emission and a high torque transmission capacity. In addition, an almost complete absence of clearance of the eccentric transmission can be achieved by a slight circumferential rotation of the toothed wheels with respect to each other.

In one technically advantageous design, a rotor shaft of the synchronous motor is configured at least sectionally as a hollow shaft into which a coupling is integrated. An extremely space-saving design is thereby given. The coupling also makes possible a problem-free assembly of the device as well as the integration into the hull of the watercraft, and simplifies the maintenance.

The rotor shaft of the synchronous motor is preferably associated with a locking device. As a result thereof, the device can be mechanically held in a prescribed position, for example, when not in use or in a rest state.

In the case of a further advantageous design, the synchronous motor is controlled by power electronics that are controlled by a control and/or regulating device. A comprehensive rotational speed and torque regulation of the synchronous motor is thereby possible, for example, in a four-quadrant operation. To ensure an optimal regulability, the synchronous motor is preferably configured as a permanently excited synchronous machine or as a so-called brushless direct-current motor ("brushless DC motor").

In the case of a favorable refinement, the synchronous motor includes at least one motor sensor that comprises a rotor position sensor for determining a rotor position angle, and a rotational speed sensor for determining a number of rotations of the rotor shaft. The regulating of the synchronous motor can thereby be further optimized.

An actual angle of the fin-carrying shaft is preferably directly detectable using a rotational angle sensor associated therewith, wherein the rotational angle sensor is configured for detecting at least one full rotation of the fin-carrying shaft. The angle of attack of the fin-carrying shaft with respect to the inflowing water is thereby directly detectable with high precision and independent of the rotor position of the synchronous motor. A possible circumferential offset or a slight torsion between the rotor shaft of the synchronous motor and the fin-carrying shaft is thus recognizable.

In one refinement the rotor position sensor and/or the rotational angle sensor are preferably each embodied as absolute sensors. In comparison to incremental rotor position sensors and incremental rotational angle sensors, a calibrating of the sensors, for example, after a power failure or after a longer operating time, to a defined position is thereby unnecessary. Furthermore, an accumulation of possible measurement inaccuracies is avoided.

A target angle of attack of the guide fin is preferably calculable based on the rotor position angle using the control and/or regulating device. A position detection of the guide fin independent from the rotational angle sensor is thereby possible with knowledge of the reduction ratio of the eccentric transmission.

In the case of a too-large deviation between the calculated target angle of attack and the actual angle of attack measured using the rotational angle sensor, an action, in particular a warning signal, a recalibration, or the like, is preferably triggerable with the aid of the control and/or regulating device and/or regulating device. The accuracy of the position regulation of the guide fin can thereby be further optimized and maintained over the service life.

In the case of one technically advantageous design, the rotor shaft of the synchronous motor, an input shaft of the eccentric transmission, an output shaft of the eccentric transmission, and the fin-carrying shaft extend essentially in alignment with each other. An optimal mechanical efficiency with simultaneously optimal smooth-running properties thereby results.

In one technical refinement of the device it is provided that the device is disposed on the hull of the watercraft such that a course influence of the watercraft is realizable in the manner of a rudder blade. An additional functionality of the device is thereby given. For example, at least one device can be disposed in the region of a stern of a watercraft, wherein the fin-carrying shaft including the guide fin is oriented in the manner of a rudder or a rudder blade essentially perpendicular to the longitudinal axis of the hull, and simultaneously oriented here in the direction of the force of gravity or toward the water floor. In the case of a use as fin stabilizer, the device or the guide fin is in contrast placed on the hull of the watercraft essentially parallel to the water surface, or at a slight angle thereto. With the use as a fin stabilizer, at least two devices are disposed in pairs and symmetrically with respect to each other with respect to the longitudinal axis of the hull of the watercraft, or on a starboard side and a port side of the hull of the watercraft. In contrast, a rudder blade can be realized with at least one device. Also in the case of a use of the device as rudder or as rudder blade for influencing the course of the watercraft, a certain stabilizing effect can be achieved with respect to rolling movements of the hull of the watercraft in the water.

BRIEF DESCRIPTION OF THE SEVERAL VIEWS OF THE DRAWINGS

In the following a preferred exemplary embodiment of the invention is explained in more detail with reference to schematic Figures.

DETAILED DESCRIPTION OF THE INVENTION

Figure 1:
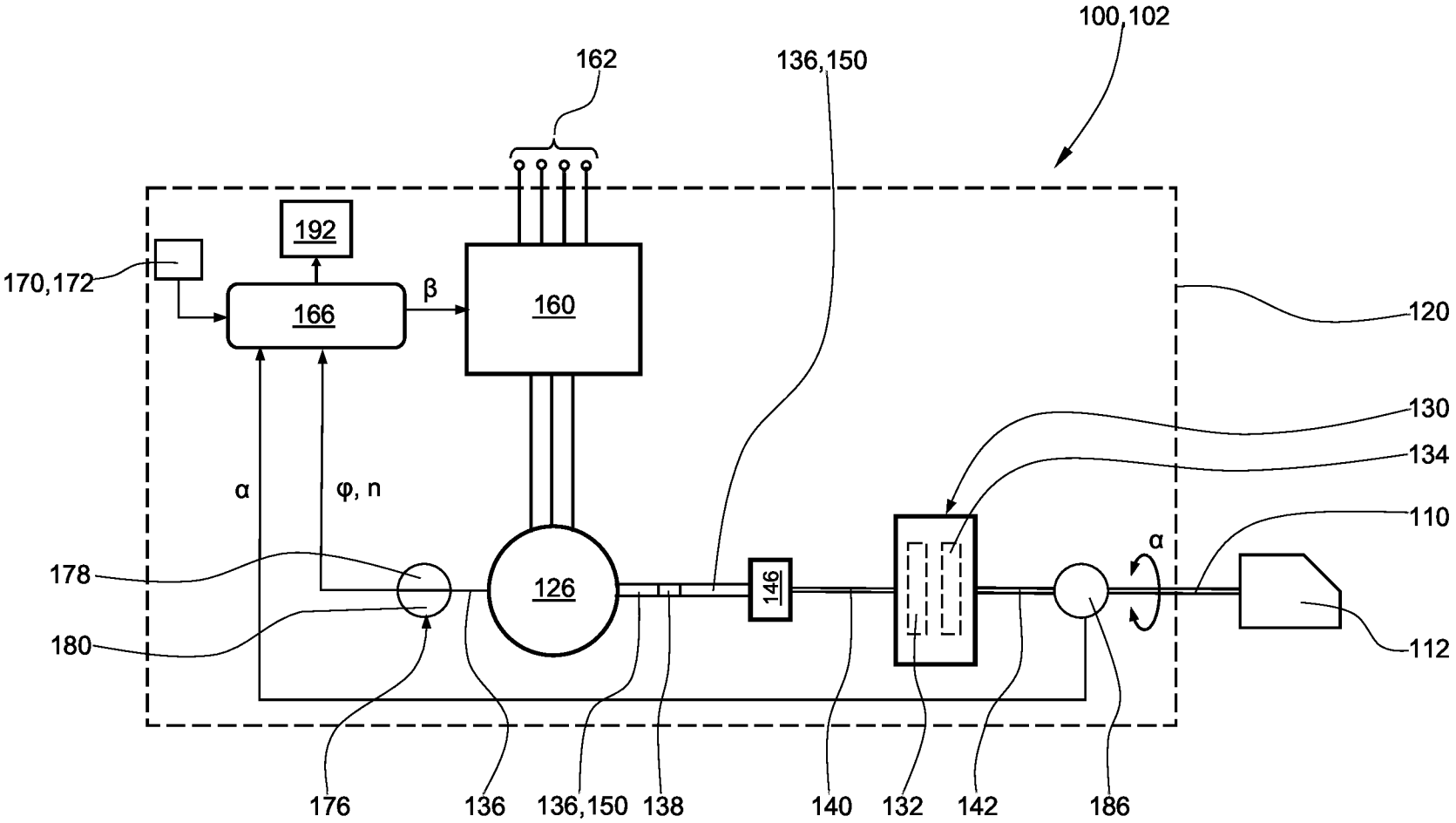
FIG. 1 shows a block diagram of a device configured exemplarily as a fin stabilizer of a ship.

FIG. 1 shows a block diagram of a device configured exemplarily as a fin stabilizer of a ship. A device 100 for the roll-stabilizing of a watercraft, not depicted here, in motion, at anchor, or at zero speed through the water and/or for influencing the course of a watercraft is embodied here only exemplarily as a fin stabilizer 102. In addition, it is possible to place the device 100 on a hull of a watercraft such that an influencing of the course of the watercraft is also possible, and the device thus assumes the function of a conventional rudder blade. This configuration is not depicted in the Figures.

The device 100 or the fin stabilizer 102 comprises inter alia a pivotable fin-carrying shaft 110 on which a guide fin 112 or a stabilizing fin is attached for preferential damping of rolling movements of the watercraft. The fin-carrying shaft 110 is oriented essentially parallel to a longitudinal axis, likewise not depicted here, of a hull of the watercraft preferably configured as a ship, wherein in a rest state or inactive state of the fin stabilizer 102, the guide fin 112 extends essentially parallel to a water surface (cf. FIG. 2; reference number 222). To change an actual angle of attack $\alpha$ of the guide fin 112, the fin-carrying shaft 110 is correspondingly pivotable using an electromechanical drive unit 120.

The electromechanical drive unit 120 comprises inter alia a synchronous motor 126 that rotationally drives the fin-carrying shaft 110 using an eccentric transmission 130 operating in a highly speed-reducing manner. The eccentric transmission 130 preferably includes two toothed wheels 132, 134 circumferentially offset with respect to each other by 180°, whereby an extensive freedom from play is ensured. The detailed constructive design of the eccentric transmission 130 operating with a conventional involute toothing is sufficiently familiar to a specialist active in the field of electromechanical drive technology, so that at this point for the sake of brevity and succinctness of the description, a detailed explanation of the eccentric transmission 130 can be omitted. The synchronous motor 126 furthermore includes a rotor shaft 136 that is connected, via a coupling 138 not releasable in operation, to an input shaft 140 of the eccentric transmission 130, such that the rotor shaft 136 and the input shaft 140 rotate together. The eccentric transmission 130 drives the fin-carrying shaft 110 including the guide fin 112 by a slowly rotating output shaft 142 so that its actual angle of attack $\alpha$ is pivotable in a range of from 0° to 360° inclusive. The rotor shaft 136 is further associated with a locking device 146, using which the rotor shaft 136 is temporarily lockable, so that, for example, when the fin stabilizer 102 is inactive the guide fin 112 is fixable or held in a suitable pivot position that opposes the surrounding water with a lowest-possible flow resistance. The rotor shaft 136 of the synchronous motor 126 is preferably embodied at least sectionally as a hollow shaft 150 into which the coupling 138 is integrated in a space-saving manner. For this purpose the hollow shaft 150 coaxially surrounds the rotor shaft 136 of the synchronous motor 126 at least sectionally. As a result thereof, a significant reduction of the axial installation space requirement of the electromechanical drive unit 120 is available.

The rotor shaft 136 of the synchronous motor 126, the input shaft 140 of the eccentric transmission 130, the output shaft 142 of the eccentric transmission 130 and the fin-carrying shaft 110 are oriented essentially aligned with respect to each other, which results in high energy efficiency paired with a small installation space requirement.

The synchronous motor 126 is controlled by power electronics 160 that are supplied from the electrical system 162 of the watercraft or of the ship. The electrical system 162 is embodied here only exemplarily as a three-phase, three-phase network with a neutral conductor. A possible protective conductor is not depicted. The power electronics 160 are comprehensively controlled or driven by a powerful digital electronic control and/or regulating device 166. Using a position sensor 170, for example, the spatial position as well as the movements or the rotational rates of the watercraft or of the ship are completely capturable in all three spatial directions. Thus all roll, pitch, and yaw movements of the hull of the ship are measurable. For simplification reasons, the position sensor 170 can be embodied as a roll sensor 172, so that at least rolling movements of the hull of the watercraft can be captured by the control and/or regulating device 160.

The synchronous motor 126 furthermore includes a motor sensor 176 coupled to the rotor shaft 136, which motor sensor 176 comprises at least one rotor position sensor 178 and at least one rotational speed sensor 180. With the aid of the rotor position sensor 178, a rotor position angle φ of the synchronous motor 126 is determinable, so that stator or rotor windings of the synchronous motor 126 are correspondingly controllable or energizable on a staggered basis. In addition, the rotational speed sensor 180 allows at least one recording of a number n of rotations performed by the rotor shaft 136. Furthermore, the current actual angle of attack α of the fin-carrying shaft 110, and thus of the guide fin 112 in the water, is directly detectable with high accuracy by the control and/or regulating device 166 using a rotational angle sensor 186, i.e., independent of the rotor position of the synchronous motor 126. The rotational angle sensor 186 on the fin-carrying shaft 110 is preferably configured for recording at least one full rotation of the fin-carrying shaft 110. The current actual angle of attack α of the fin-carrying shaft 110 with respect to the inflowing water is thereby capturable directly from the control and/or regulating device 166 with high accuracy and independent of the rotor position of the synchronous motor. A possible circumferential offset or a slight torsion between the rotor shaft 136 of the synchronous motor 126 and the fin-carrying shaft 110 is detectable and compensatable by a suitable controlling of the synchronous motor 126 using the power electronics 160 controlled by the control and/or regulating device 166, which results in an optimal roll-stabilization of the ship.

Both the rotor position sensor 178 and the rotational angle sensor 186 are each preferably embodied as so-called absolute sensors with high precision, so that inter alia a recalibration due to accumulating measurement inaccuracy or after a power failure is unnecessary.

The control and/or regulating device 166 is also configured to determine, based on the measured rotor position angle φ, a target angle β of attack R of the guide fin 112 to be specified for optimal roll-stabilizing of the ship, so that using the synchronous motor 126 controlled by the power electronics 160, the fin-carrying shaft 110 of the guide fin 112 can be correspondingly rotated via the interposed eccentric transmission 100. This regulating process is preferably effected with simultaneous consideration of the measured values, supplied by the position sensor 170, with respect to the spatial position of the ship in the water. In the case of a too-large deviation between the calculated target angle of attack R and the actual angle of attack α measured using the rotational angle of rotation sensor 186, the control and/or regulating device 110 is further configured to additionally trigger an action 192 by the control and/or regulating device 166, for example, in the form of a warning signal, a recalibrating of the fin stabilizer 102, or the like.

The control and/or regulating device 166 is further provided to dampen as effectively as possible at least periodic rolling movements, and in the ideal case also all pitch and yaw movements of the ship in the water based on the measurement signals or measured values supplied by the sensors by suitable controlling of the synchronous motor 126 with the aid of the power electronics 160. For this purpose, corresponding regulating algorithms are implemented inside the preferably digital electronic control and/or regulating device.

Figure 2:
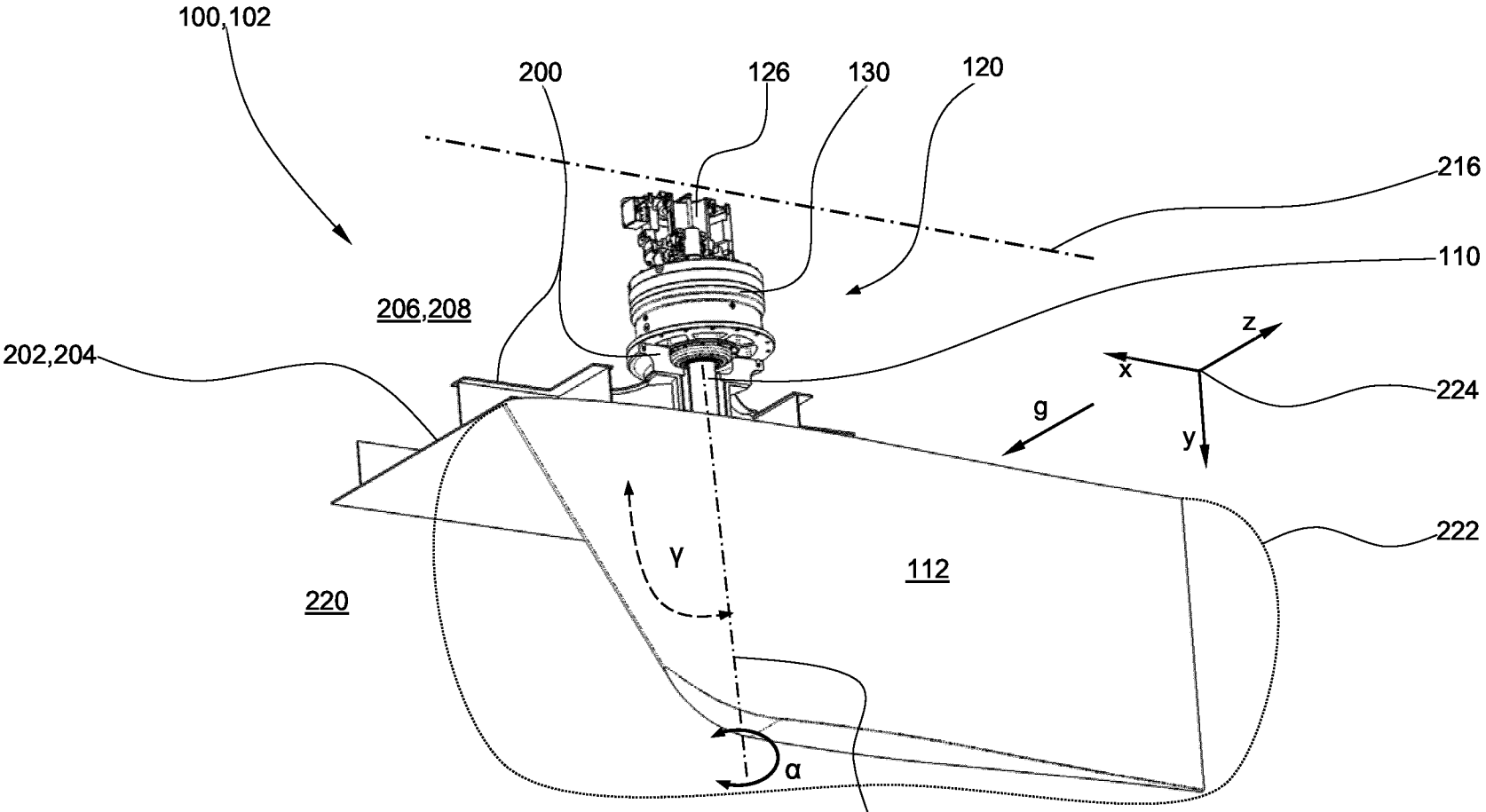
FIG. 2 shows a perspective view of the fin stabilizer of FIG. 1 obliquely from above.

FIG. 2 illustrates a perspective view of the fin stabilizer of FIG. 1 obliquely from above. The fin stabilizer 102 is attached inside to a hull skin 202 of a hull 204 of a ship 206 using a base 200. The ship 206 is mentioned here only exemplarily as an example of an arbitrary watercraft 208 including a hull, wherein the inventive fin stabilizer 102 can be used. The guide fin 112 is attached to the fin carrying shaft 110 guided through the hull skin 202. A longitudinal central axis 210 of the fin carrying shaft 110 extends essentially perpendicular to a longitudinal axis 216 of the hull 204 of the ship 206. Using the electromechanical drive unit 120, the actual angle of attack α of the fin-carrying shaft 110, and thus the guide fin 112 can be pivoted with respect to the surrounding water 220 by the control and/or regulating device in a range of preferably 0° to 360°, or between ±180°, including the respective interval limits. In the position of the guide fin 112 illustrated in FIG. 2, it extends here, merely by way of example, essentially parallel to and below a merely graphically indicated water surface 222, i.e., the actual angle of attack α of the guide fin 112 is set here exemplarily to an actual angle of attack α of approximately 0°.

An installation angle γ between the longitudinal central axis 210 of the fin-carrying shaft 110 and the horizontal plane extending parallel to the xy-plane of the coordinate system 224 can in principle fall between 0° and 90°. With an installation angle γ of 90°, the longitudinal central axis 210 of the fin-carrying shaft 110 of the guide fin 112 of the fin stabilizer 102 extends perpendicular to the horizontal plane and thus parallel to the orientation of the gravitational field g, wherein the hull skin 202 extends in the region of a base of the ship 206 or of the watercraft 208.

If the fin stabilizer 102 is disposed with an installation angle γ of approximately 90°, for example, in a stern region (stern) and usually disposed there behind the propeller of the ship 206 or of the watercraft 208, the device 100 can additionally act as a rudder for influencing the course of the ship 206.

If the longitudinal central axis 210 extends at an installation angle γ of approximately 0°, i.e., approximately parallel to the horizontal plane or parallel to the xy-plane 224 (water surface 222), and thus also perpendicular to the direction of the force of gravity g, then a rudder effect of the fin stabilizer 102 is precluded. In general, the installation angle γ of fin stabilizers not pivotable in the hull 204 of the ship 206 or of the watercraft 208 falls at a value of approximately 45°.

A right-angle coordinate system 224 illustrates the spatial position of all components in relation to each other. The longitudinal axis 216 of the hull 204 of the ship 206 extends approximately parallel to the x-axis, and the longitudinal central axis 210 of the fin-carrying shaft 110 is oriented essentially parallel to the y-axis or transverse to the longitudinal axis 216 of the hull 204, while the z-axis of the coordinate system 224 is directed parallel to the gravitational force or to the direction of action of gravity approximately orthogonal to the water surface 222. The rolling movements of the hull 204 of the ship 206, which rolling movements are to be damped primarily using the control and/or regulating device 100 or the fin stabilizer 102, occur about the x-axis of the coordinate system 224, while pitch movements occur about the y-axis and yaw movements about the z-axis.

The electromechanical drive unit 120 in turn comprises inter alia the synchronous motor 126 including the eccentric transmission 130 connected downstream thereto for realizing a high mechanical reduction.

Figure 3:
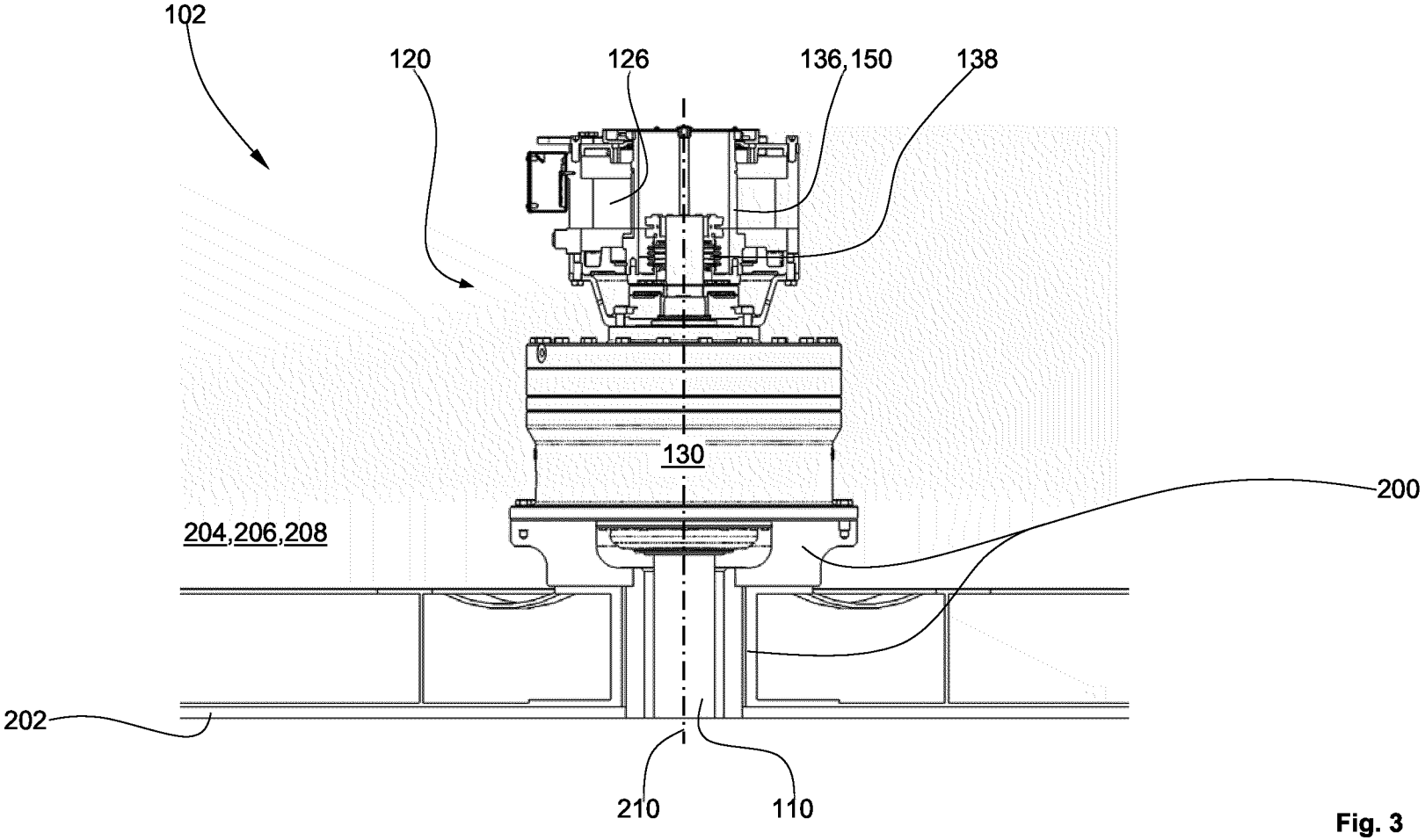
FIG. 3 shows a partial longitudinal section of the fin stabilizer of FIG. 2.

FIG. 3 shows a partial longitudinal section of the fin stabilizer of FIG. 2. The fin stabilizer 102 is fixedly connected to the hull skin 202 of the hull 204 of the ship 206 or of a watercraft 208 using the base 200. The fin-carrying shaft 110 is sealingly guided through the hull skin 202 of the ship 206, and is rotatable about its longitudinal central axis 210 using the electromechanical drive unit 120. The guide fin 112 connected to the fin-carrying shaft 110 is not drawn in the depiction of FIG. 3. The electromechanical drive unit 120 of the inventive fin stabilizer 102 again comprises the synchronous motor 126, whose rotor shaft 136, preferably configured as hollow shaft 150, is connected to the eccentric transmission 130 using the coupling 138 such that the rotor shaft 136 and the eccentric transmission 130 rotate together. The eccentric transmission 130 is for its part coupled to the fin-carrying shaft 110 such that they rotate together.

As a partial aspect of the invention, the coupling 138 is disposed coaxially inside the hollow shaft 150 at least sectionally, from which a considerable reduction of the required axial installation space of the fin stabilizer 102 results along the longitudinal central axis 210. The mechanical coupling 138 is not intended for short-term opening or releasing. Rather, the coupling 138 simplifies inter alia the installation and a possibly required removal of the fin stabilizer 102 for repair purposes, maintenance purposes, or the like. In addition, it can be seen from FIG. 3 that the rotor shaft 136 of the synchronous motor 126, the coupling 138, the eccentric transmission 130, and the fin-carrying shaft 110 are aligned with respect to one another along the longitudinal central axis 210, which results in a high energy efficiency of the fin stabilizer 102.

Figure 4:
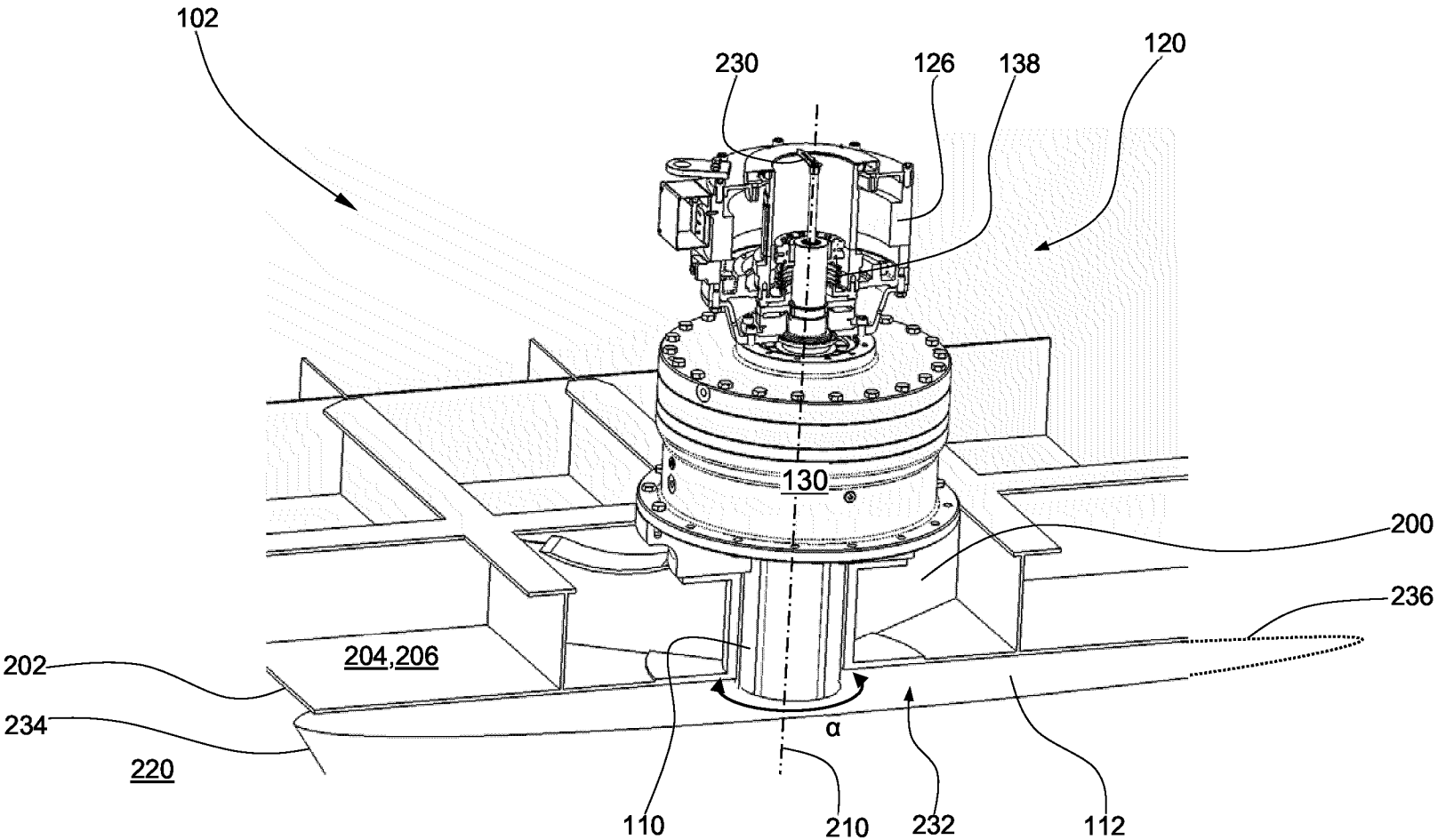
FIG. 4 shows an enlarged perspective view of an electromechanical drive unit of the fin stabilizer.

FIG. 4 shows an enlarged perspective view of an electromechanical drive unit of the fin stabilizer.

The fin stabilizer 102 is attached inside to the hull skin 202 of the hull 204 of the ship 206 using a base 200. The fin-carrying shaft 110 is rotatable about its longitudinal central axis 210 by the drive unit 120 and is guided through the hull skin 202 in a water-tight manner. The electromechanical drive unit 120 comprises the synchronous motor 126, the coupling 138, and the eccentric transmission 130 including the fin-carrying shaft 110 and the guide fin 112 attached thereto. As a purely visual exemplary embodiment for the rotational angle sensor 186, the synchronous motor 126 includes a needle-type, mechanical indicator element 230 in order to provide an optical visualization for the viewer of the current actual angle of attack $\alpha$ of the fin-carrying shaft 110 of the guide fin 112 in the interior of the hull 204 of the ship 206. For this purpose the indicator element 230 is mechanically coupled to the fin-carrying shaft 110 in a suitable manner. The guide fin 112 includes a streamline shaped cross-sectional profile 232 including an inflow edge 234 and an outflow edge 236 for the surrounding water 220.

The fin stabilizer 102 described here merely by way of example for an inventive device for roll-stabilizing of a ship requires a reduced installation space requirement, causes only minimal operating noises, and has an optimal regulability for optimal damping of undesirable rolling movements about the longitudinal axis of the ship 206.

The invention relates to a device (100) for the roll-stabilizing of a watercraft (208) in motion, at anchor, or at zero speed, and/or for influencing the course of the watercraft (208), including a fin-carrying shaft (110) on which a guide fin (112) is disposed, wherein for changing an actual angle of attack (a) of the guide fin (112) in the water (220), the fin-carrying shaft (110) is drivable by an electromechanical drive unit (120), and the drive unit (120) is disposed on the hull (204) using a base (200). According to the invention it is provided that the electromechanical drive unit (120) is configured with a synchronous motor (126) that drives the fin-carrying shaft (110) using a reducing eccentric transmission (130). The device (100) thereby has a significantly reduced installation space requirement, causes only slight operating noises, and is also optimally electronically regulable.

REFERENCE NUMBER LIST

100 Device
102 Fin stabilizer
110 Fin-carrying shaft
112 Guide fin
120 Drive unit (Angle of attack)
126 Synchronous motor
130 Eccentric transmission
132 Toothed wheel
134 Toothed wheel
136 Rotor shaft (synchronous motor)
138 Coupling
140 Input shaft
142 Output shaft
146 Locking device
150 Hollow shaft
160 Power electronics
162 Electrical system
166 Control and/or regulating device
170 Position sensor
172 Roll sensor
176 Motor sensor
178 Rotor position sensor
180 Rotational speed sensor
186 Rotational angle sensor
192 Action
200 Base
202 Hull skin
204 Hull
206 Ship
208 Watercraft
210 Longitudinal central axis (fin-carrying shaft)
216 Longitudinal axis (hull)
220 Water
222 Water surface
224 Coordinate system
230 Indicator element
232 Cross-sectional profile
234 Inflow edge
236 Outflow edge
g Gravitational force (gravity)
$\alpha$ Actual angle of attack (stabilizing fin)
$\beta$ Target angle of attack (stabilizing fin)
$\gamma$ Installation angle
$\varphi$ Rotor position angle
n Number of rotations

The invention claimed is:

1. A device for the roll-stabilizing of a watercraft in motion, at anchor, or at zero speed, and/or for influencing the course of the watercraft, the watercraft including a hull, the device comprising:

a fin-carrying shaft on which a guide fin is disposed; and an electromechanical drive unit for changing an actual angle of attack of the guide fin in the water and configured to drive the fin-carrying shaft, the drive unit being disposed on the hull using a base and including a synchronous motor configured to drive the fin-carrying shaft and including a hollow rotor shaft, a reducing eccentric transmission disposed between and axially separating the motor and the fin-carrying shaft and having an input shaft disposed partially within the hollow rotor shaft of the motor, and a coupling connecting the input shaft of the reducing eccentric transmission to the hollow rotor shaft of the motor.

2. The device according to claim 1, wherein the eccentric transmission includes two toothed wheels.

3. The device according to claim 1, wherein the rotor shaft of the synchronous motor is associated with a locking device.

4. The device according to claim 1, wherein the synchronous motor is controlled by power electronics that are controlled by a control and/or regulating device.

5. The device according to claim 4, wherein the synchronous motor includes at least one motor sensor that includes a rotor-position sensor for determining a rotor-position angle and a rotational speed sensor for determining a number n of rotations of the rotor shaft.

6. The device according to claim 5, wherein an actual angle of attack of the fin-carrying shaft is directly capturable using a rotational angle sensor configured for detecting at least one full rotation of the fin-carrying shaft.

7. The device according to claim 6, wherein the rotor-position sensor and/or the rotational angle sensor are each embodied as an absolute sensor.

8. The device according to claim 6, wherein the control and/or regulating device triggers a warning signal and/or a recalibration when a deviation between the calculated target angle of attack and the actual angle of attack measured using the rotational angle sensor exceeds a predetermined value.

9. The device according to claim 5, wherein a target angle of attack of the guide fin is calculable based on the rotor-position angle using the control and/or regulating device.

10. The device according to claim 1, wherein a rotor shaft of the synchronous motor, an input shaft of the eccentric transmission, an output shaft of the eccentric transmission and the fin-carrying shaft are essentially aligned with respect to each other.

11. The device according to claim 1, wherein the device is disposed on the hull of the watercraft such that an influencing of the course of the watercraft is realizable in the manner of a rudder blade.

12. A device for the roll-stabilizing of a watercraft in motion, at anchor, or at zero speed, and/or for influencing the course of the watercraft, the watercraft including a hull, the device comprising:

a fin-carrying shaft on which a guide fin is disposed; and an electromechanical drive unit for changing an actual angle of attack of the guide fin in the water and configured to drive the fin-carrying shaft, the drive unit being disposed on the hull using a base and including a synchronous motor configured to drive the fin-carrying shaft using a reducing eccentric transmission;

wherein the synchronous motor is controlled by power electronics that are controlled by a control and/or regulating device and includes at least one motor sensor that includes a rotor-position sensor for determining a rotor-position angle and a rotational speed sensor for determining a number n of rotations of the rotor shaft; and wherein an actual angle of attack of the fin-carrying shaft is directly capturable using a rotational angle sensor configured for detecting at least one full rotation of the fin-carrying shaft and the control and/or regulating device triggers a warning signal and/or a recalibration when a deviation between the calculated target angle of attack and the actual angle of attack measured using the rotational angle sensor exceeds a predetermined value.

* * * * *